US007013671B1

(12) United States Patent
Bolda

(10) Patent No.: US 7,013,671 B1
(45) Date of Patent: Mar. 21, 2006

(54) LUNCH BOTTLE PACK

(76) Inventor: Daniel H. Bolda, 2303 N. Rte. 23, Marengo, IL (US) 60152

( * ) Notice: Subject to any disclaimer, the term of this patent is extended or adjusted under 35 U.S.C. 154(b) by 65 days.

(21) Appl. No.: 10/761,929

(22) Filed: Jan. 21, 2004

Related U.S. Application Data

(60) Provisional application No. 60/441,617, filed on Jan. 21, 2003.

(51) Int. Cl.
*F25D 3/08* (2006.01)
*A45C 11/20* (2006.01)

(52) U.S. Cl. ..... 62/457.7; 62/457.4; 62/457.3; 62/457.1; 206/541; 206/542; 206/545; 206/549; 224/148.1; 224/148.4; 224/148.7

(58) Field of Classification Search ..... 206/217, 206/541, 542, 545, 547, 549; 220/737, 739; 224/148.1, 148.4, 148.7; 62/457.1, 457.3, 62/457.4, 457.7
See application file for complete search history.

(56) References Cited

U.S. PATENT DOCUMENTS

| | | | | | |
|---|---|---|---|---|---|
| 4,468,933 | A * | 9/1984 | Christopher | ..... | 62/457.1 |
| 5,915,580 | A * | 6/1999 | Melk | ..... | 215/386 |
| 5,971,200 | A * | 10/1999 | Reynolds | ..... | 220/694 |
| 6,067,813 | A * | 5/2000 | Smith | ..... | 62/371 |
| 6,105,844 | A * | 8/2000 | Walters et al. | ..... | 224/610 |
| 6,116,045 | A * | 9/2000 | Hodosh et al. | ..... | 62/457.4 |
| 6,513,343 | B1 * | 2/2003 | Pahl | ..... | 62/457.3 |

* cited by examiner

*Primary Examiner*—David T. Fidei

(57) ABSTRACT

A liquid container is encased in an insulated jacket type pack, which has back-straps and a handle for ease of carrying, pockets for storage and zippered openings for access to the liquid container. The liquid container has recessed drink holders located near the bottom of the container with another recessed opening for sandwich type storage. The container has a spout at the top for drinking or pouring liquid from the container.

6 Claims, 4 Drawing Sheets

12
18
18A
36
38

LUNCH BOTTLE PACK

CROSS-REFERENCES TO RELATED APPLICATIONS

This application claims the benefit of U.S. provisional application No. 60/441,617, filed Jan. 21, 2003.

STATEMENT REGARDING FEDERALLY SPONSORED RESEARCH OR DEVELOPMENT

Not Applicable.

REFERENCE TO SEQUENCE LISTING, A TABLE, OR COMPUTER PROGRAM LISTING APPENDIX SUBMITTED ON A COMPACT DISC

Not Applicable.

BACKGROUND OF THE INVENTION

1. Field of Invention

The present invention relates to a portable device for cooling, and maintaining both food and drinks in a cooled condition, such as is useful while hiking, fishing, hunting or cycling, or carrying to school or to a job site where no refrigeration is conveniently available.

More particularly, the invention relates to a portable cooling unit having a container to hold, preferably consumable, cooling medium (e.g., ice water, Gatorade) and provided with pockets to receive and hold food (e.g., sandwiches, containerized food) and drinks (packaged or containerized, e.g., cans, cartons) for cooling thereof, and an insulated covering (e.g., insulated jacket) surrounding the cooling container, the container or covering being provided with handles and/or straps for carrying the unit from place to place.

2. Description of Prior Art

The concept of the development of the invention was the result of years of the inventor carrying multiple units, often at the same time, to a job site to satisfy diverse needs, and particularly to cool and/or keep cool both food (e.g., sandwiches), packaged drinks, and bulk drink at locations where refrigeration was not available.

Presently, in order to have both cold liquid in relatively large quantity (e.g., ice water), and to have a different drink (e.g., a can of pop or carton of juice) and a sandwich (or other containerized food) for lunch such as at a remote job site, and to keep everything cold, typically requires one insulated container (e.g. a jug) for the cold bulk liquid product, and a second insulated container for the sandwich and pop or juice, as well as any other perishable items. It would be advantageous if a single insulated container were provided that carried cooled bulk liquid, a sandwich and can of pop (or other lunch-type items). However, prior to the present invention, the inventor is aware of no such single insulated container that is available or known.

SUMMARY OF THE INVENTION

The general aim of the present invention is to provide new and improved apparatus with a container having pockets (or holders) for both sandwiches (or a smaller contained or containerized food product) and packaged drinks (e.g., cans, carton or pouches), the container being formed with a recessed opening to establish a surrounded space to accept and hold a cold liquid in bulk to cool the sandwiches and packaged drinks and is itself available for drinking throughout the day.

Accordingly, an important objective of the invention is that the recessed opening in the container that accepts and holds cold liquid, such as ice and water, substantially surrounds sandwich and drink holders which in turn will keep them ice cold for later consumption.

The sandwich and drink holders are located near the bottom of the cooling container so that the cold temperature from the ice and cold liquid in the container will keep the food and drink cold as the cold drops to the bottom.

The outside of the lunch bottle case is insulated to keep the contents cold for a long period of time, and prevent condensation on the outside of the container. The outside is preferably an outer covering with zippered access to the container (i.e., the covering is removable from the container) for ease of cleaning, and with zippered (snap, Velcro, etc.) access to the sandwich and drink holders in the container for ease of access thereto, along with pockets sewn to the outer covering for additional storage.

These and other objectives and advantages of the invention will become more apparent from the following detailed description when taken in conjunction with the accompanying drawings.

Figure 2:
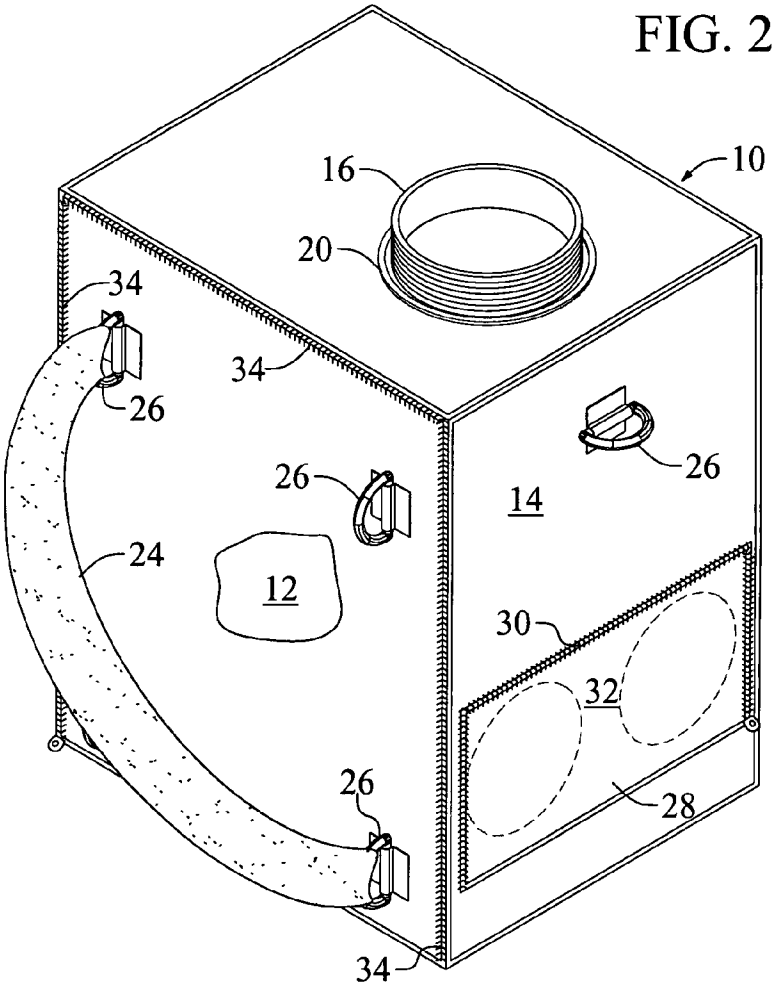
FIG. 2 is an opposite perspective view of the lunch bottle pack shown in FIG. 1, but shown without a removable lid to the inside container and provided with a mono-strap on the back for carrying the pack.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

Figure 1:
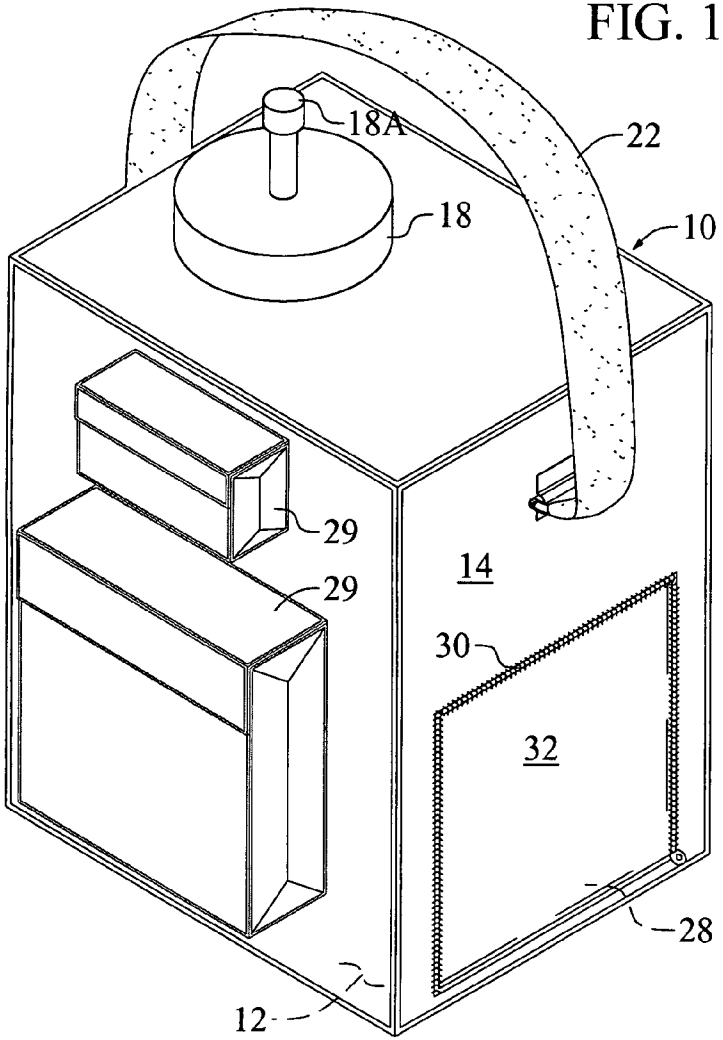
FIG. 1 is a perspective view of a lunch bottle pack in accordance with the invention, and shown provided with a top carrying strap.
Figures 3, 4, 5, 6, 7, 8:
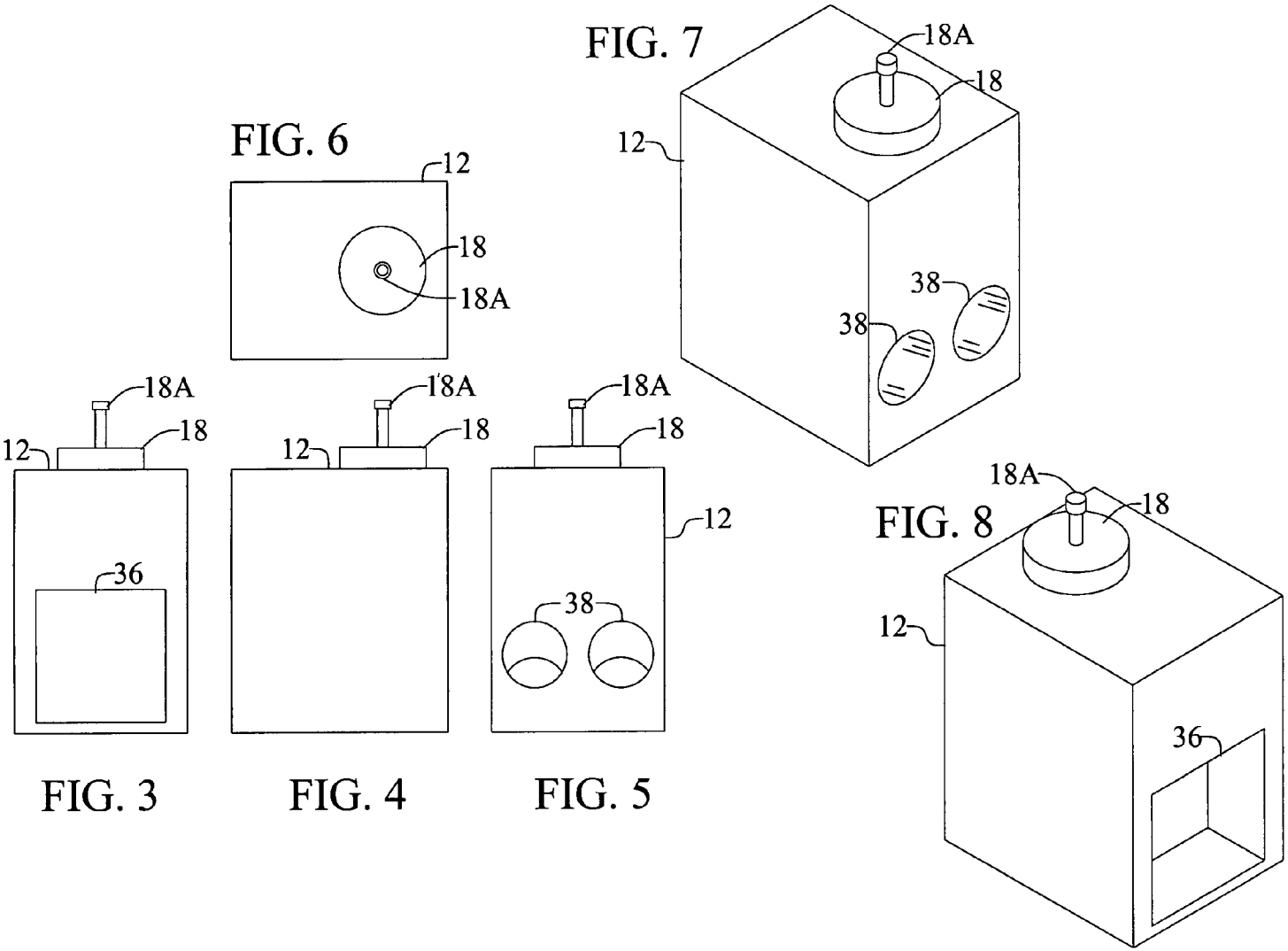
FIGS. 3–8 are left side, front, right side, back and top views of the inside container shown as made from a non-transparent material.
Figures 9, 10, 11, 12, 13, 14:
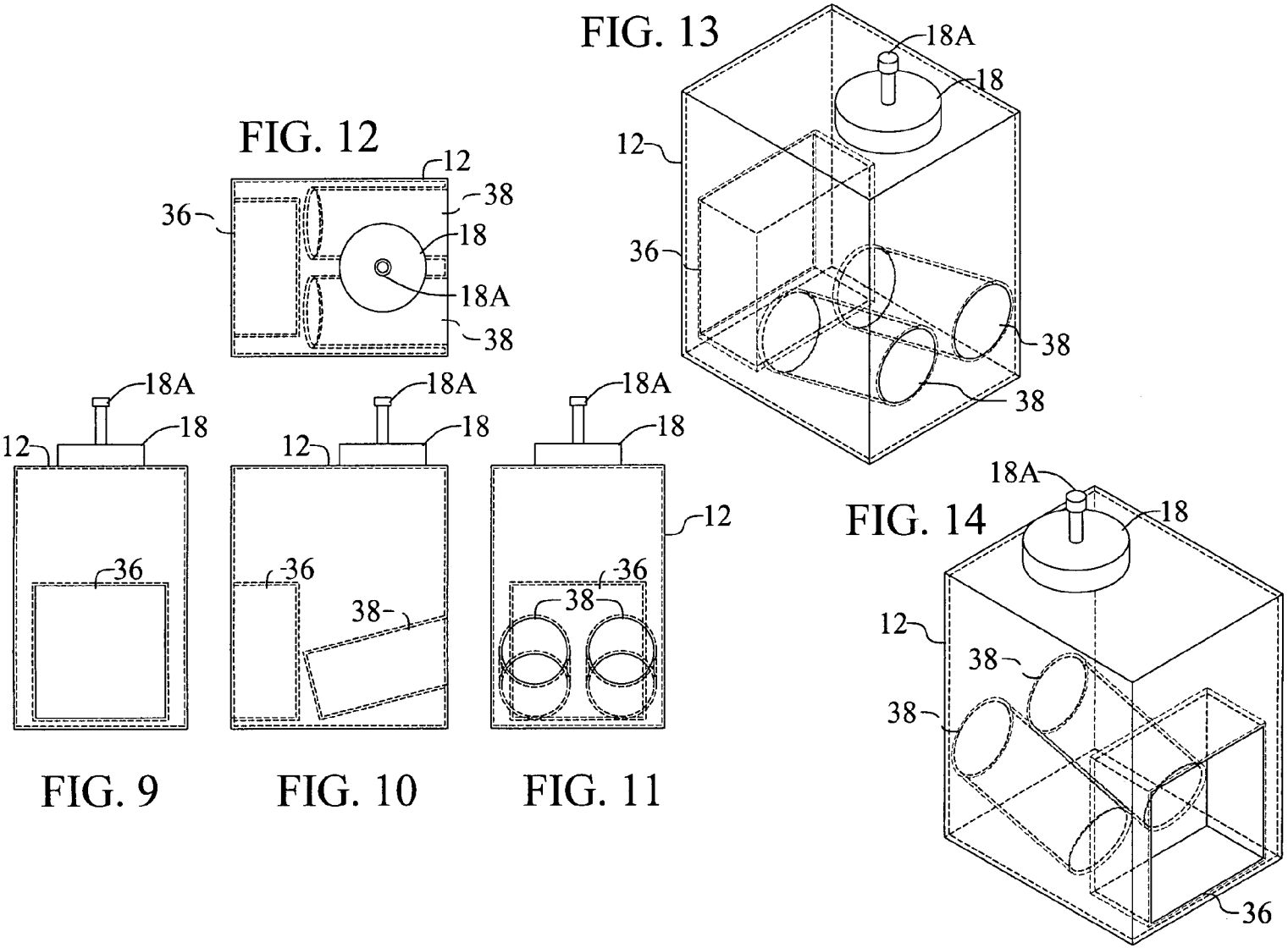
FIGS. 9–14 are views similar to FIGS. 3–8 but shown as made from a transparent material, with the inside material lines shown in dashed lines.

Referring to FIGS. 1–2, there is shown front and back perspective views of a preferred embodiment, new lunch bottle pack 10 in accordance with the invention.

The lunch bottle pack 10 includes an inside, molded plastic container 12, and an outside, encasing jacket 14. The jacket is sized to slip-fit snugly around the container, and is provided with zippered access such as at sides 34 for installation and removal of the container from the jacket. The jacket is made from durable canvas, nylon, leather, or other material such as suitable for outdoors bags and back packs, with a suitable insulating material sewn on the inside thereof or between an outer layer and inside lining. Alternately, the jacket is provided with flexible joints for bending of zippered access openings. The top of the jacket is provided with a reinforced opening 20 through which a spout 16 of the container 10 extends when the container is installed into the jacket. The upper portion of the container is provided with a spout 16 that extends through reinforced opening 20 in the jacket. A drinking spout cap 18 with a removable top 18*a* is removably carried (shown threaded) on the spout. A handle or strap such as top shoulder strap 22 (FIG. 1) connected to D-rings 26 secured to the sides of the insulated jacket, a mono-back strap 24 (FIG. 2) secured to back D-rings 26, or a pair of back straps (FIG. 16) are secured for ease of carrying the bottle pack from place to place. The jacket is optionally provided with additional accessory or "carry-all" storage pockets 29 with Velcro, zippered, snap or other closure flaps, and additional D-rings or other article carrying devices as desired. For access to food and drink pockets 36, 38 (discussed below), the jacket includes side openings 28 with covers 32 zippered as indicated 30.

Referring to FIGS. 3–8, the outside details of the inside container 12 are shown such as if the container is made from a non-transparent material, to obscure internal details. The container is generally closed, with a main surrounded space established with top, bottom and surrounding sides, to hold a cooling medium such as ice and/or cold water. The spout 16 and removable lid 18 located near or at the top of the container enable filing and emptying the container with bulk cooling liquid, such as ice/water, and for drinking or pouring the cooled water therefrom if desired.

Molded pockets or recesses 36 and 38 are formed in the sides of the container 12 for holding sandwiches, snacks, and other contained or containerized foods, and for holding cans, pouches, cartons, boxes, bottles, etc. of drink. The pockets are generally closed for isolation from the inside of the container (and the liquid therein) but generally open at the container sides for access thereto to receive and hold sandwiches, packaged drinks, etc. The food and drink pockets are located near the bottom of the container so that the cold from the ice or chilled liquid in the container drops thereon for maximum cooling of the contents therein, even throughout the day as some of the liquid in the container may be drank. As shown in FIGS. 9–14 in which the inside details of the container are shown in dashed lines, the drink container pockets 38 are preferably inclined downwardly from the open sides so that the drink therein is biased down and into the recess to assist in normally maintaining the drink in the pocket. The pockets may be provided with desired shapes, with a rectangular pocket shown for a sandwich and cylindrical pockets for canned drinks.

As an example only, one suitable sized container is approximately 10 inches wide×12 inches high×6 inches deep. The container may be provided in larger or smaller sizes as desired.

Figure 17:
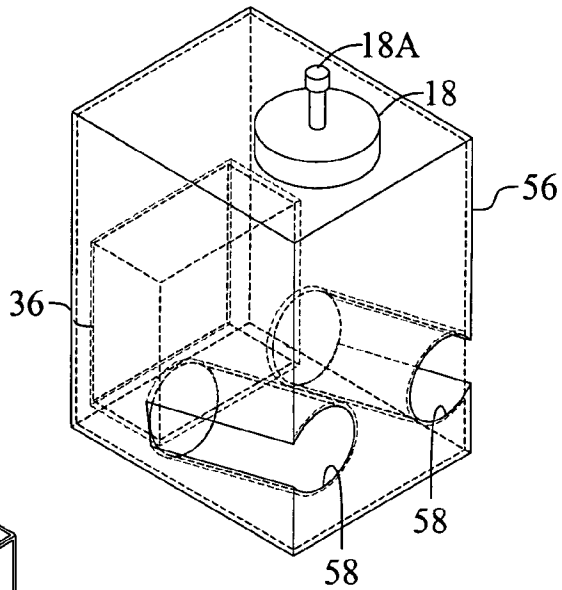
FIG. 17 is a perspective view of a second alternate inside container in accordance with the invention.
Figure 16:
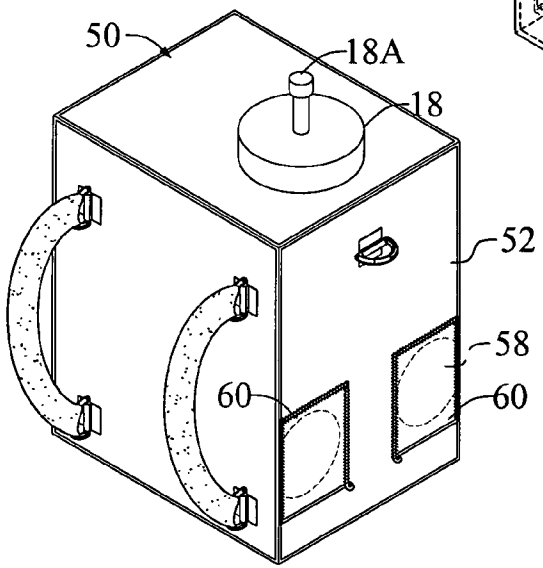
FIG. 16 is a perspective view of a lunch bottle pack with the alternate container shown in FIG. 15.
Figure 15:
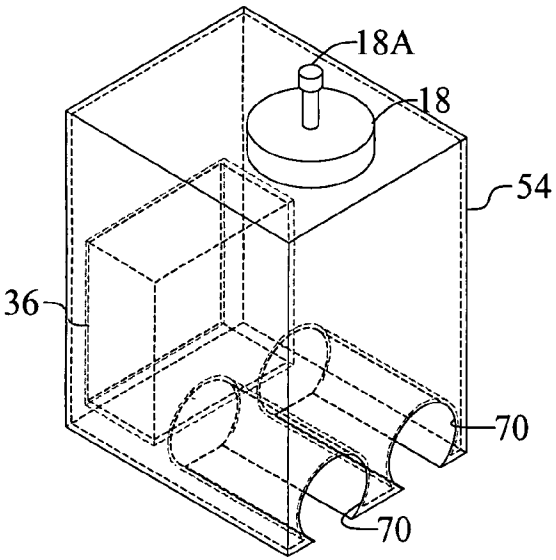
FIG. 15 is a perspective view of an alternate inside container in accordance with the invention.

An alternate embodiment lunch bottle pack 50 is shown in FIGS. 16 and 17. This alternate pack includes insulating jacket 52 and inside container 56. The insulating jacket and container of this alternate embodiment are as described above in connection with pack 10, except that the beverage pockets 58 are located intersecting the sides of the container adjacent the openings thereof, and zippered access openings 60 in the jacket are individually provided. It is believed that, for certain molding procedures, this configuration may provide ease and less cost of molding the container. In a second alternate embodiment, for alternate molding purposes, the container 54 is provided with beverage pockets intersecting the bottom of the container. In both alternate embodiments, the diameter of the cylinder is greater that 50% enclosed, or for other shaped pockets, to prevent the can or other container therein from tending to fall out as the pack is carried. Although the jacket would normally keep the drink in the pocket even if the open sides were larger, the substantially enclosing nature of the preferred pockets absorbs the impact from a can therein as it may be jostled around, to reduce the side forces on the jacket.

Enclosed herewith, and incorporated herein be specific reference thereto, is a copy of the provisional application to which this application claims priority.

From the foregoing, it will be clear that the present invention brings to the art a new and unique device for keeping food and drinks cold, while simultaneously providing bulk quantity of cooled liquid available for drinking. The pack of the present invention combines, and provides in one integral unit, a large "water bottle" and a cooled lunch pack. The pack enables, for example, a worker to drink the ice water throughout the morning, while keeping his lunch cool, and still have ice water left for afternoon consumption. The pack of the present invention eliminates the drawbacks of using two separate containers as is current practice, and also eliminates the need for "wasting" ice or dealing with refreezable ice packs as are often currently used. The pack of the present invention provides a new and unique device to keep food and drinks cool for extended periods of time, along with making available a quantity of bulk liquid for drinking throughout the day.

I claim:

1. A portable insulated pack for storing food and drinks in a cooled environment, the pack comprising:

(a) a molded, generally closed plastic container having a top and bottom and surrounding sides to define a water-tight surrounded space to hold cooling liquid, the upper portion of the container being provided with an access opening to said surrounded space, a first side of the container being formed with at least one substantially closed-form food pocket defined by a closed back and closed sides extending laterally from the back of the pocket to a front access opening established generally coincident with the first side of the container, a second side of the container being further formed with at least one substantially closed-form drink package-sized pocket defined by a closed back and closed sides extending laterally from the back of the pocket to a front access opening established generally coincident with the second side of the container, (b) a cap releasably secured to the opening in the upper portion of the container, the cap having a removable lid for drinking liquid from the container, (c) an insulated jacket sized for a snug fit around the container, the jacket having:

an opening in the upper portion through which said cap extends, a closable access opening through which the container is installable into and removable therefrom, closable access openings aligned with the front access openings of the food and drink pockets, and (d) a carry strap secured in fixed relation to the jacket.

2. The pack as defined in claim 1 in which the sides of the drink package-sized pocket incline upwardly upon progressing from the closed back to the open front thereof.

3. The pack as defined in claim 1 in which the drink package-sized pocket intersects a side of the container adjacent the front access opening thereof.

4. The pack as defined in claim 1 in which the drink package-sized pocket is generally cylindrical.

5. The pack as defined in claim 1 in which the drink package-sized pocket is generally rectangular.

6. The pack as defined in claim 1 in which the food pocket is generally rectangular.

* * * * *